US012137817B2

(12) United States Patent
Wu et al.

(10) Patent No.: US 12,137,817 B2
(45) Date of Patent: Nov. 12, 2024

(54) INTERLOCKING MECHANISM FOR SEAT AND BACK OF CHAIR

(71) Applicant: COMFORDY CO., LTD., Tainan (TW)

(72) Inventors: Yu-Ling Wu, Tainan (TW); Armin Roland Sander, Fürth (DE); Martin Potrykus, Bamberg (DE)

(73) Assignee: Comfordy Co., Ltd., Tainan (TW)

( * ) Notice: Subject to any disclaimer, the term of this patent is extended or adjusted under 35 U.S.C. 154(b) by 195 days.

(21) Appl. No.: 18/049,754

(22) Filed: Oct. 26, 2022

(65) Prior Publication Data

US 2024/0138572 A1 May 2, 2024

(51) Int. Cl.
*A47C 7/02* (2006.01)

(52) U.S. Cl.
CPC ..... *A47C 7/02* (2013.01)

(58) Field of Classification Search
CPC ..... A47C 7/02
USPC ..... 297/311
See application file for complete search history.

(56) References Cited

U.S. PATENT DOCUMENTS 5,511,852 A * 4/1996 Kusiak ..... A47C 7/402 297/301.4
7,036,882 B2 * 5/2006 Elzenbeck ..... A47C 1/03238 297/300.1
7,922,248 B2 * 4/2011 Aldrich ..... A47C 7/027 297/316
8,419,133 B2 * 4/2013 Holt ..... A47C 7/027 297/284.3
11,596,232 B2 * 3/2023 Goetz ..... A47C 7/024
11,812,870 B2 * 11/2023 Deevers ..... A47C 7/004
2013/0069406 A1 * 3/2013 Ko ..... A47C 1/03279 297/313
2013/0334855 A1 * 12/2013 Chen ..... A47C 1/024 297/313

FOREIGN PATENT DOCUMENTS

CN 215271602 U 12/2021
TW M599751 U 8/2020

* cited by examiner

*Primary Examiner* — Anthony D Barfield
(74) *Attorney, Agent, or Firm* — Rosenberg, Klein & Lee

(57) ABSTRACT

An interlocking mechanism for a seat and a back of a chair is provided. A seat body and a chair chassis are pivotally connected, and a pad plate is pivotally connected with the seat body. Thereby the pad plate is moved around a pivotal connection between itself and the seat body when users sit on the pad plate. While a front side of the pad plate is moved downward, it is inclined to an angle slowly by a pad spring connected with the pad plate. When the use is leaning on the chair back connected with the seat body, the seat body is moved backward with a pivotal connection between itself and the chair chassis. The pivotal connection between the seat body and the pad plate can push the pad plate upward so that the seat body is inclined with the chair back and the user sits more comfortably.

10 Claims, 9 Drawing Sheets

INTERLOCKING MECHANISM FOR SEAT AND BACK OF CHAIR

BACKGROUND OF THE INVENTION

Field of the Invention

The present invention relates to a chair, especially to an interlocking mechanism for a seat and a back of a chair.

Description of Related Art

Refer to Taiwanese Pat. Pub. No. M599751 (U) "linking mechanism for seat base and backrest is revealed" and Chinese Pat. Pub. No. CN215271602 (U) "chair able to tilt forward and backward", when users sit on the chair and lean against the backrest, the backrest is tilted and the seat base is also moved along with the backrest and inclined. Thereby the users can sit more comfortably. However, the linking mechanism for seat base and backrest available now has complicated design with many components so that production cost is high and a large volume occupies much space. Thereby overall appearance of the chair is affected.

Thus there is room for improvement and there is a need to provide a novel chair.

SUMMARY OF THE INVENTION

Therefore, it is a primary object of the present invention to provide an interlocking mechanism for a seat and a back of a chair which interlocks the seat with the back and features on simple structure, low production cost, and compact designed volume.

The interlocking mechanism for a seat and a back of a chair according to the present invention has the following advantages.

1. The interlocking mechanism for a seat and a back of a chair according to the present invention has simple structure and low production cost. The effective use of space inside the seat is beneficial to flattening of the interlocking mechanism for the seat and the back and further giving an aesthetic appearance. Thereby users are more willing to buy the product and the product is more competitive in the market.
2. When the user is leaning against the chair back, the user's body is also pushed upward by the interlocking mechanism for the seat and the back. Body weight of the user sitting on the seat is carried by a force exerted by the user himself against the chair back. Thus weight activation effect is achieved.
3. A connection plate is arranged between a pad plate and a support spring and there is an angle of about 6 degrees formed between the connection plate and the pad plate. Thereby the pad plate is tilted at the angle of 6 degrees when the user sits on the pad and the user feels more comfortable.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
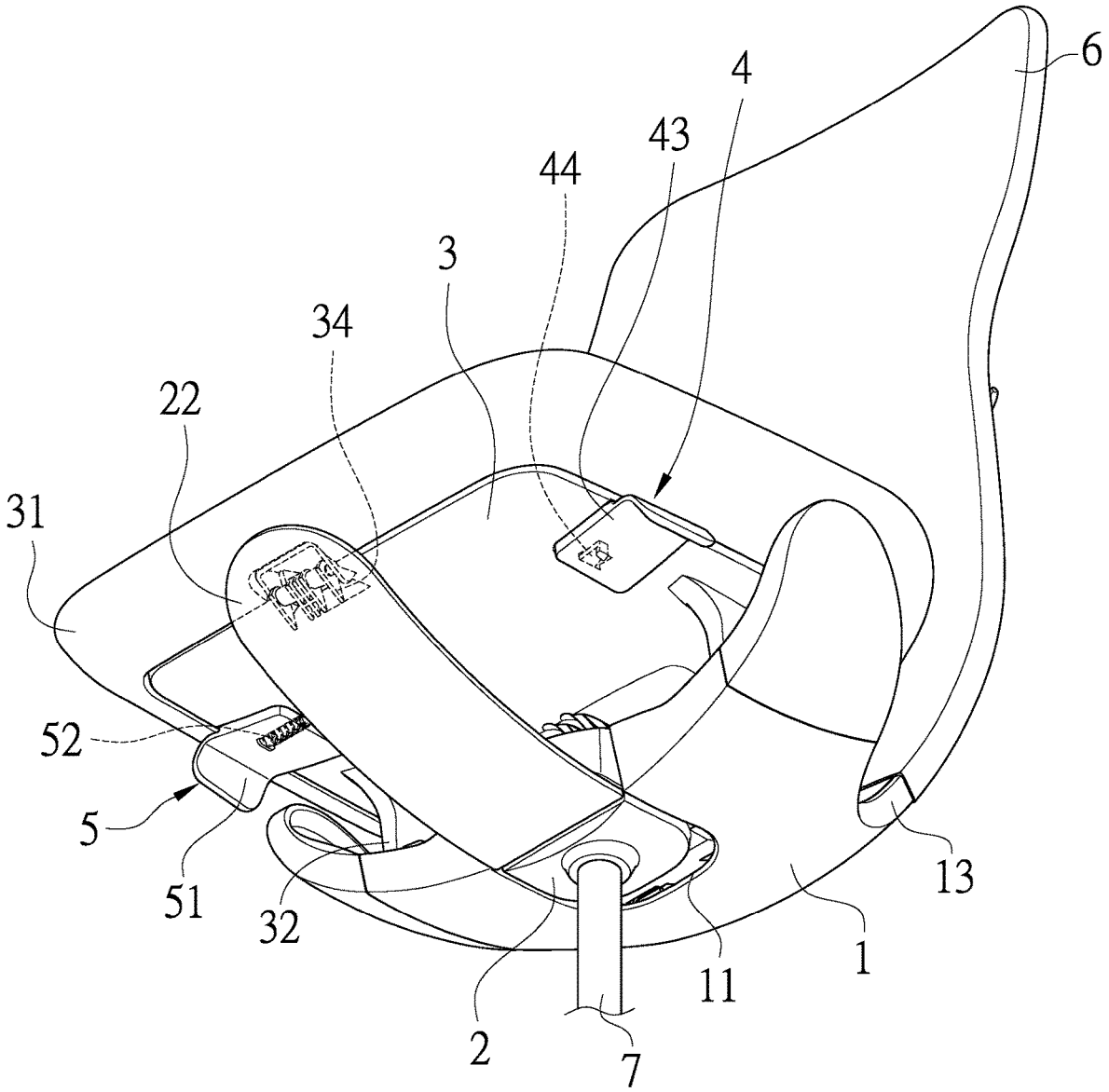
FIG. 1 is a perspective view of an embodiment according to the present invention.

Refer to FIG. 1, an interlocking device for a seat and a back of a chair according to the present invention mainly includes a seat body 1, a chair chassis 2, a pad plate 3, a chair-back controller 4, and a lifting control unit 5.

The seat body 1 consists of a chassis assembly portion 11 disposed on a front side thereof, a chair-back assembly portion 13 arranged at a rear side thereof, and a spring assembly groove 12 mounted between the chassis assembly portion 11 and the chair-back assembly portion 13. A rear wall of the spring assembly groove 12 is arranged just adjacent to the chair-back assembly portion 13, and a chair back 6 is connected with the chair-back assembly portion 13.

Figure 2:
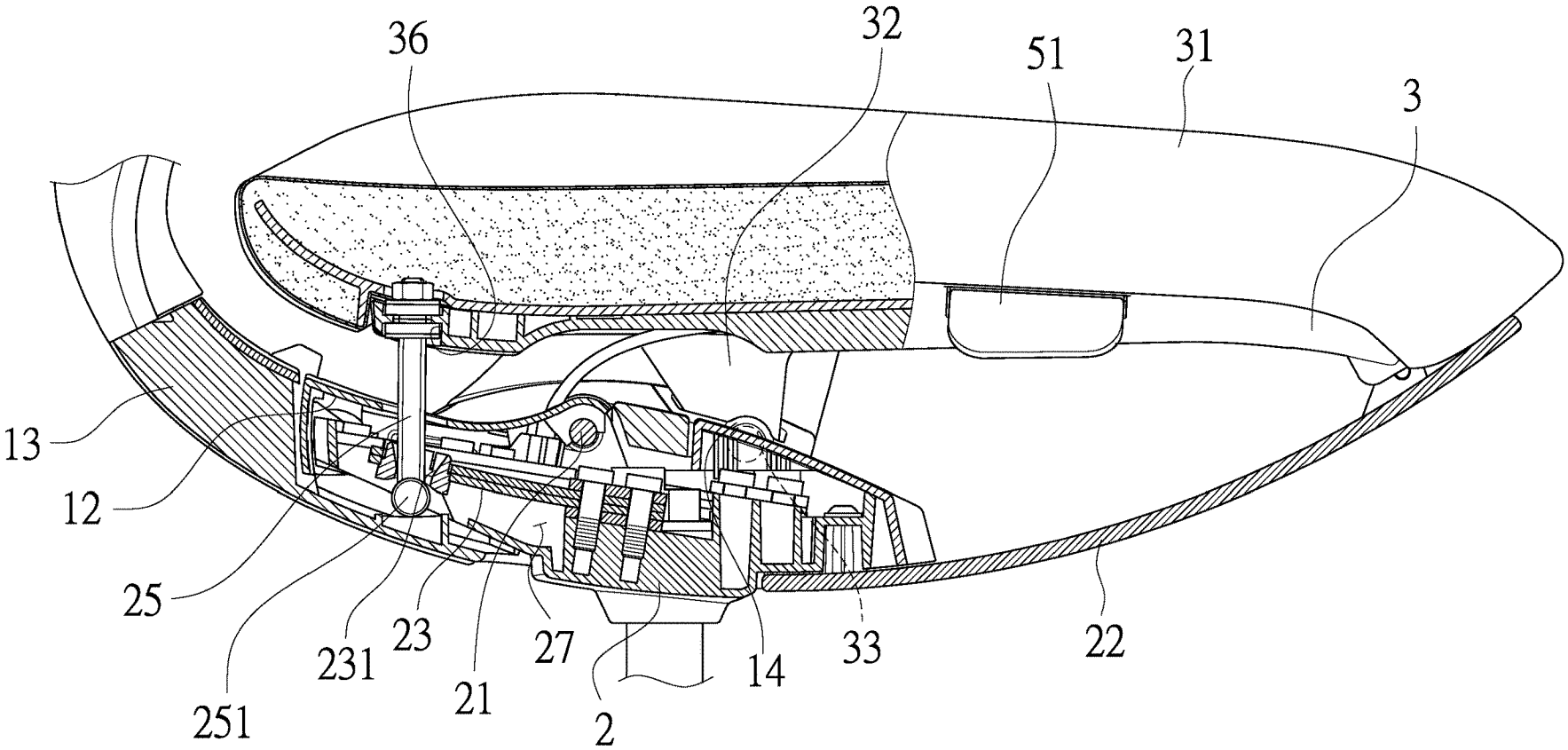
FIG. 2 is a sectional view of an embodiment according to the present invention.
Figure 3:
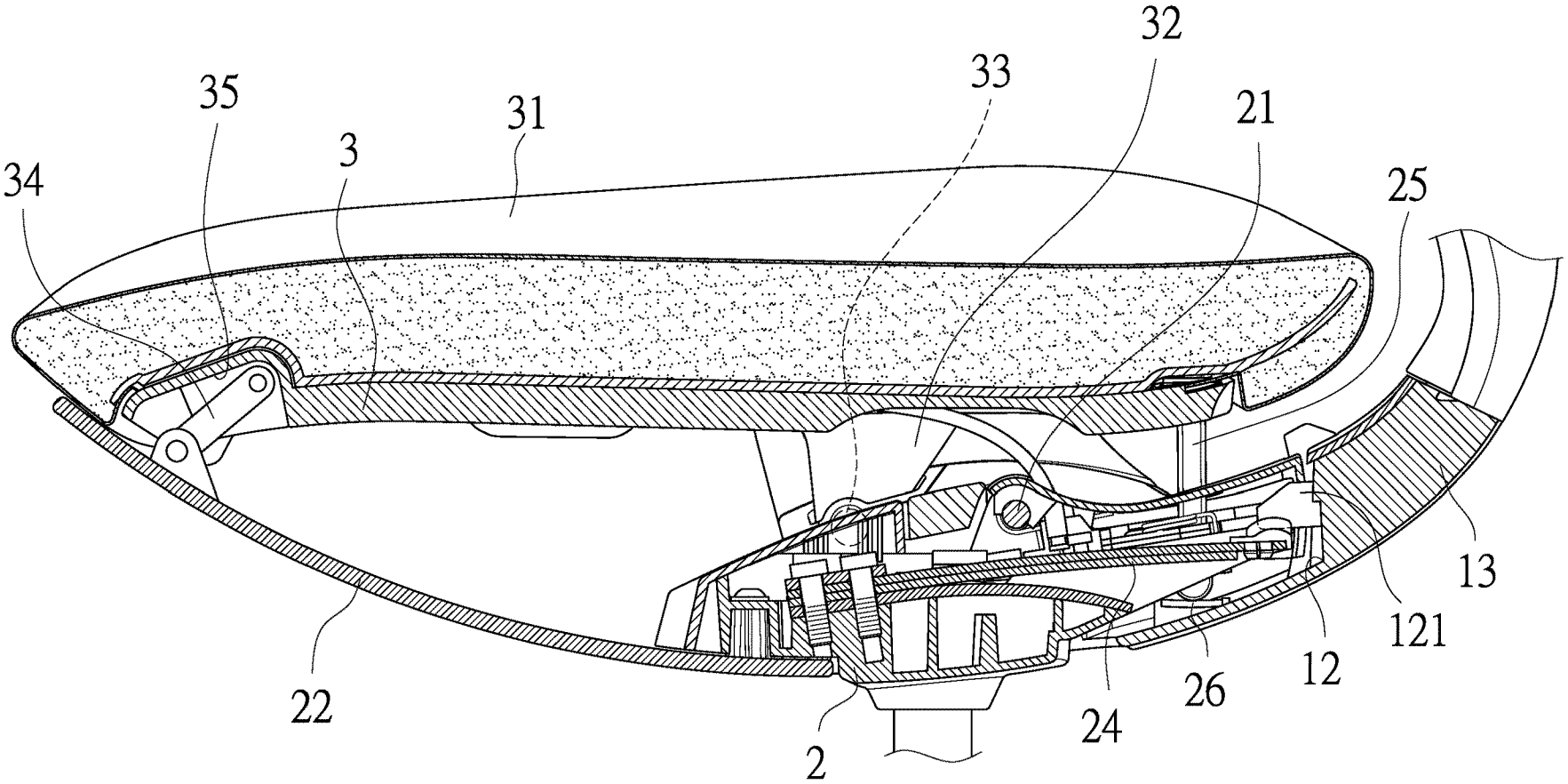
FIG. 3 is another sectional view of an embodiment according to the present invention.

Also refer to FIG. 2 and FIG. 3, the chair chassis 2 is arranged at the chassis assembly portion 11 of the seat body 1 and provided with at least one first pivot 21 inserted through the chair chassis 2 and the chassis assembly portion 11 of the seat body 1 for pivotal connection with the seat body 1. A front side of the chair chassis 2 is connected with a rear end of a support spring 22 which is extending forward from the chair chassis 2. The support spring 22 is curved upward from the rear end to a front end thereof. At least one pad spring 23, at least one back spring 24, and a rod are mounted in the spring assembly groove 12 of the seat body 1. In this embodiment, there is a plurality of pad springs 23 stacked over one another. There is also a plurality of back springs 24 stacked over one another. Front ends of both the pad springs 23 and the back springs 24 are connected with a rea side of the chair chassis 2. A rear end of the pad spring 23 is provided with a through hole 231 and the rod 25 is inserted through the through hole 231 of the pad spring 23. A stopping portion 251 is arranged at a bottom end of the rod 25 and abutting against a bottom surface of the pad spring 23. The rear wall of the spring assembly groove 12 is provided with a locking portion 121 corresponding to the back spring 24 for locking and positioning a rear end of the back spring 24. A silencer pad 26 is arranged at a bottom of the spring assembly groove 12 and located under the pad springs 23 and the back springs 24 for reducing noises generated during movement of the pad springs 23 and the back springs 24. A lifting bar 7 is disposed at a center of a bottom of the chair chassis 2 and able to be a pneumatic rod. A button 71 is disposed on an upper end of the lifting bar 7 and mounted in a hollow portion 27 of the chair chassis 2.

Figure 4:
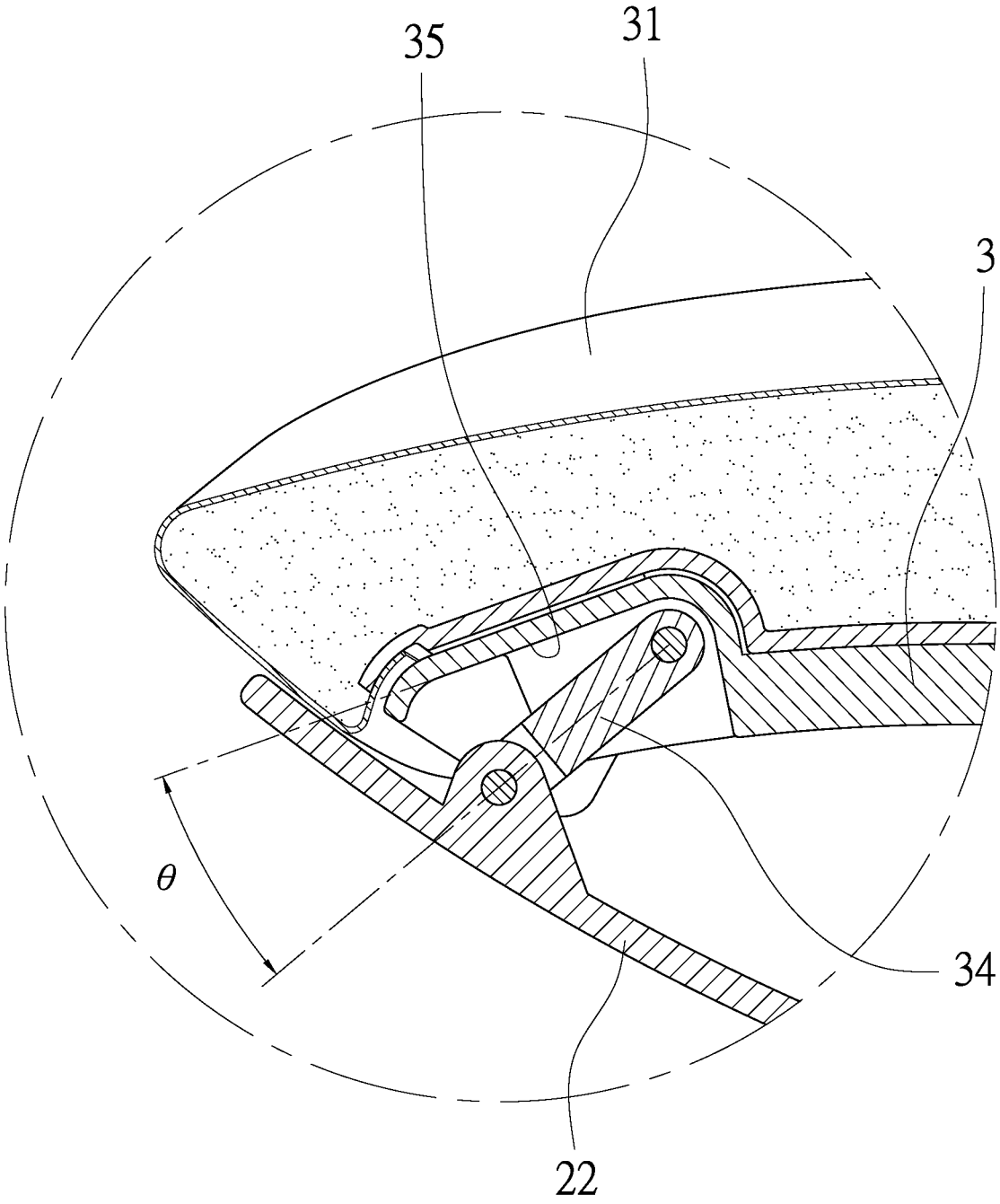
FIG. 4 is a partial enlarged sectional view of an embodiment according to the present invention.

The pad plate 3 is located over the seat body 1 and the chair chassis 2 and composed of a pad 31 arranged on a top surface of the pad plate 3, two pivot lugs 32 disposed on left and right sides of a bottom surface of the pad plate 3 correspondingly, two second pivots 33 which are inserted through the pivot lugs 32, a connecting plate 34, a mounting groove 35, and a fastening hole 36. Two pivot portions 14 are disposed on left and right sides of the seat body 1 correspondingly and located at positions opposite to each other. The pivot portion 14 of the seat body 1 is pivotally connected with the pivot lug 32 of the pad plate 3 by the second pivot 33 inserted through the pivot portion 14 of the seat body 1 and the pivot lug 32 of the pad plate 3. The pivotal connection between the pad plate 3 and the seat body 1 is located in front of the pivotal connection between the seat body 1 and the chair chassis 2. A center of the first pivot 21 for the pivotal connection between the seat body 1 and the chair chassis 2 is higher than a center of the second pivot 33 for the pivotal connection between the seat body 1 and the pad plate 3. The fastening hole 36 is mounted on a rear side of the pad plate 3 and allowing a top end of the rod of the chair chassis 2 to insert through and fastened therein. Also refer to FIG. 4, the connection plate 34 is arranged between a front side of the pad plate 3 and a front end of the support spring 22 of the chair chassis 2. An upper end and a lower end of the connection plate 34 are respectively pivotally connected with the pad plate 3 and the support spring 22 and the connection plate 34 is tilted downward with a positive slope. Thereby there is an angle θ (about 6 degrees) formed between the connection plate 34 and the pad plate 3. The mounting groove 35 for mounting the connection plate 34 therein is arranged at a bottom surface of the front side of the pad plate 3.

Figure 5:
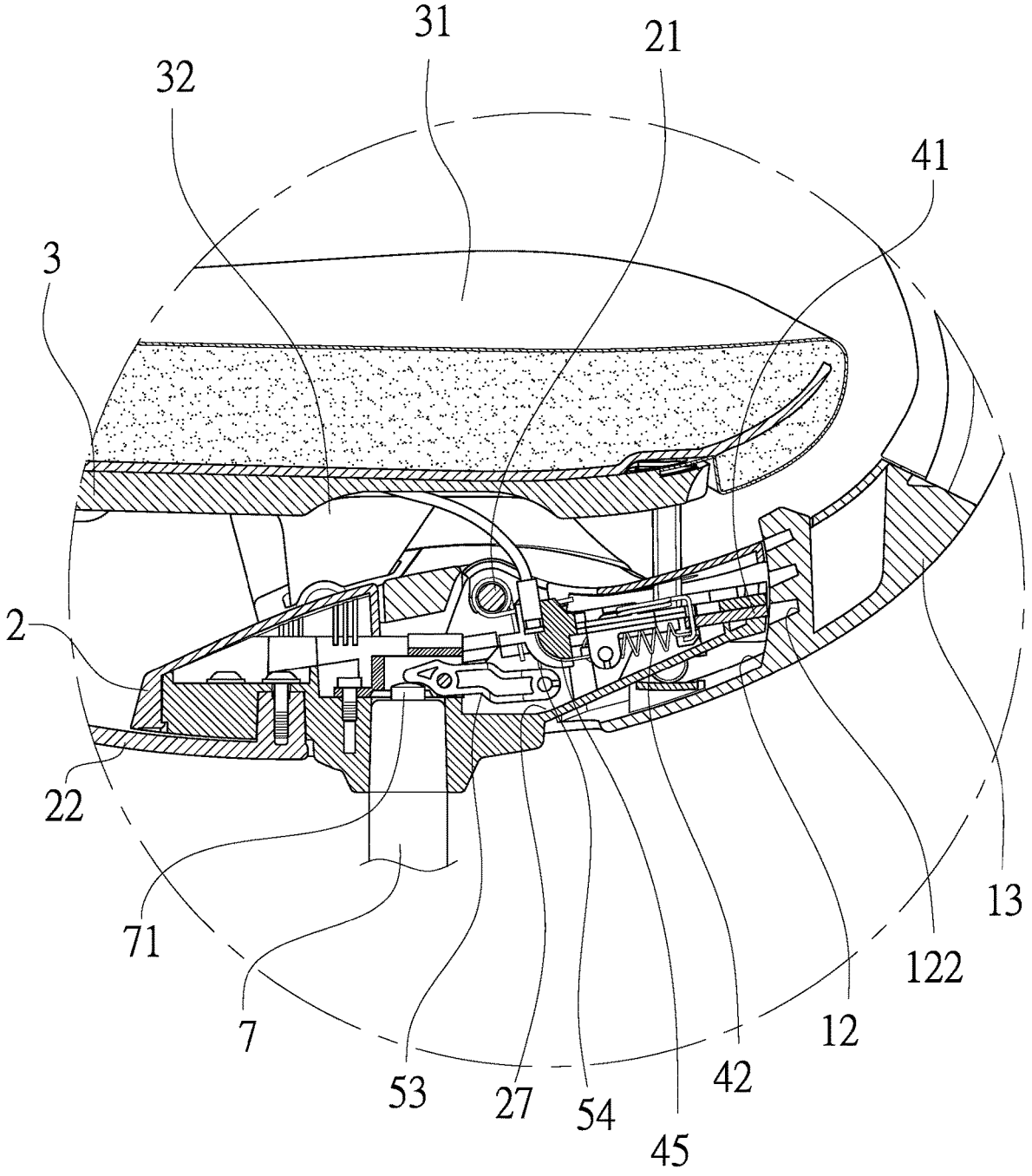
FIG. 5 is another partial enlarged sectional view of an embodiment according to the present invention.

Refer to FIG. 1 and FIG. 5, the chair-back controller 4 consists of a tenon 41 mounted in the spring assembly groove 12 of the seat body 1, a first elastic member 42 disposed between the rear wall of the spring assembly groove 12 and the tenon 41, a first control plate 43 arranged at either the left side or the right side of the bottom surface of the pad plate 3, a fastening member 44 disposed between the first control plate 43 and the pad plate 3, and a first cord 45 for connecting the first control plate 43 and the tenon 41. The first elastic member 42 is an extension spring. The rear wall of the spring assembly groove 12 is provided with at least one locking groove 122. In this embodiment, a plurality of locking grooves 122 is disposed vertically on the rear wall of the spring assembly groove 12 and spaced apart from one another. The tenon 41 is locked into one of the locking grooves 122 during adjustment according to user's needs.

The lifting control unit 5 is composed of a second control plate 51, a second elastic member 52, a driving handle 53, and a second cord 54. The second control plate 51 is arranged at one side of the bottom surface of the pad plate 3, opposite to the side with the first control plate 43. The second control plate 51 and the pad plate 3 are connected by the second elastic member 52 which is an extension spring. The driving handle 53 is disposed in the hollow portion 27 of the chair chassis 2 and pivotally connected with the chair chassis 2. A front end of the driving handle 53 is in contact with the button 71 of the lifting bar 7, and a rear end of the driving handle 53 is connected with the second control plate 51 by the second cord 54.

Figure 6:
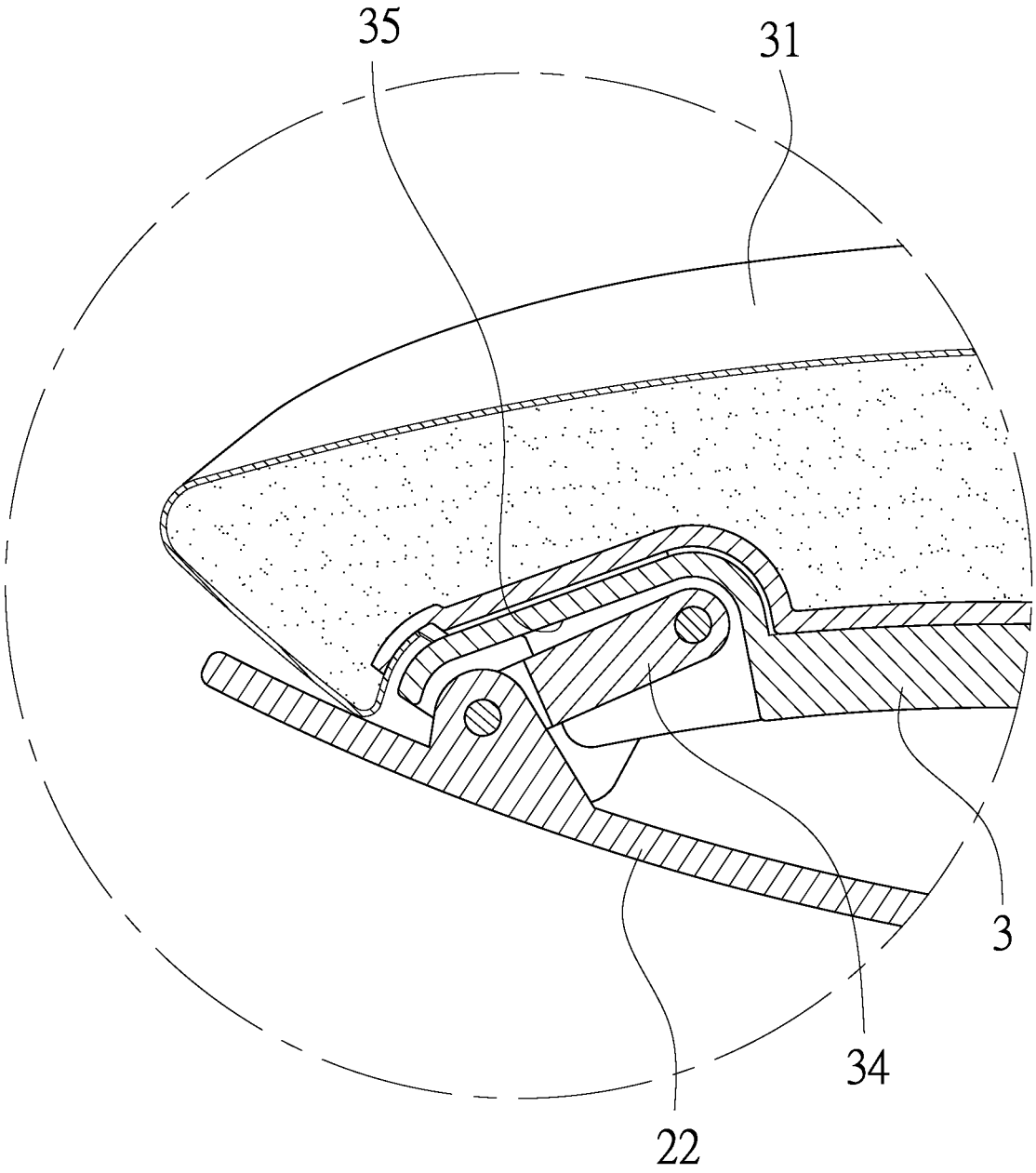
FIG. 6 is a partial enlarged sectional view showing a seat being sat of an embodiment according to the present invention.

While in use, a user sits on the pad 31. While bearing the user's weight, the pad plate 3 is moved around the second pivot 33 where the seat body 1 and the pad plate 3 are pivotally connected and then the front side of the pad plate 3 is moved downward. At the same time, the rear side of the pad plate 3 is moved upward relatively. By the rod 25 located at the rear side of the pad plate 3, the pad spring 23 connected with the rod 25 is also pulled up. Due to elastic buffering of the pad spring 23, the front side of the pad plate 3 is moved downward slowly to be abutting against and positioned by the front end of the support spring 22. Also refer to FIG. 6, the connection plate 34 is mounted in the mounting groove 35 of the pad plate 3 and the front side of the pad plate 3 is tilted at the angle of 6 degrees to make the user feel more comfortable while sitting on the pad 31.

Figure 7:
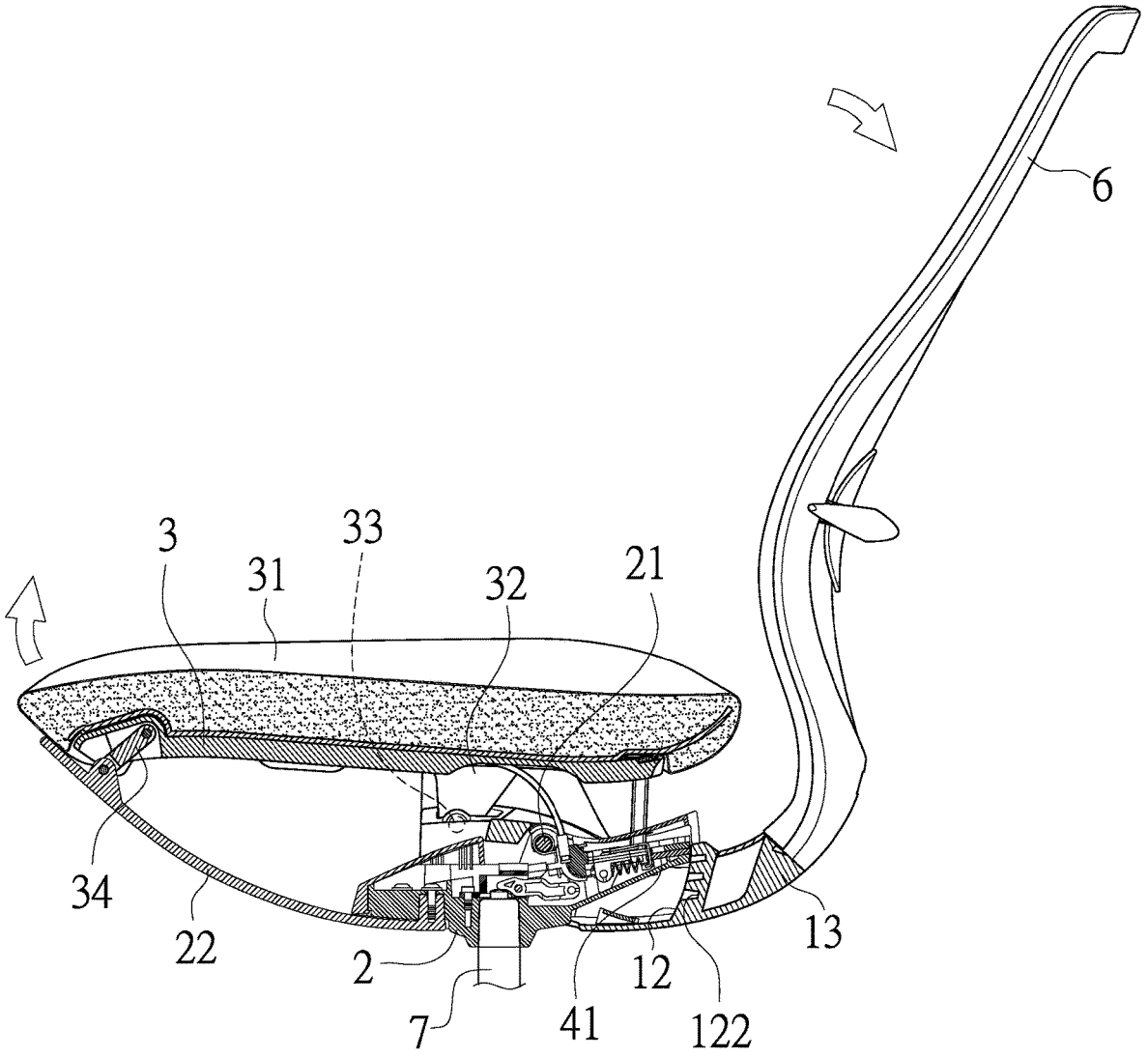
FIG. 7 is a sectional view showing a chair back being leant against of an embodiment according to the present invention.

Also refer to FIG. 7, when the user is leaning against the chair back 6 and further pushing the chair-back assembly portion 13 backward, the chair back 6 has an elastic swing due to elastic buffering effect of the back spring 24 arranged adjacent to the chair-back assembly portion 13. When the user moves body's center of gravity backward gradually, the rear end of the seat body 1 connected with the chair back 6 is moved downward and backward along with the chair back 6 by using the first pivot 21 as the pivot. The first pivot 21 is where the seat body 1 and the chair chassis 2 are pivotally connected. The seat body 1 is located in front of the pivotal connection between the seat body 1 and the chair chassis 2. At the moment, the pivotal connection between the seat body 1 and the pad plate 3 formed by the second pivot 33 is moved upward relatively to push the pad plate 3 upward through the pivot lugs 32 on the left and the right sides of the pad plate 3. Thereby body weight of the user sitting on the pad 31 of a chair seat is carried by a force exerted by the user himself against the chair back 6. Thus the user's body is synchronously pushed upward to achieve weight activation effect. Therefore, the user sits on the chair more comfortably due to the chair back 6 and the chair seat interlocked with each other.

Figure 8:
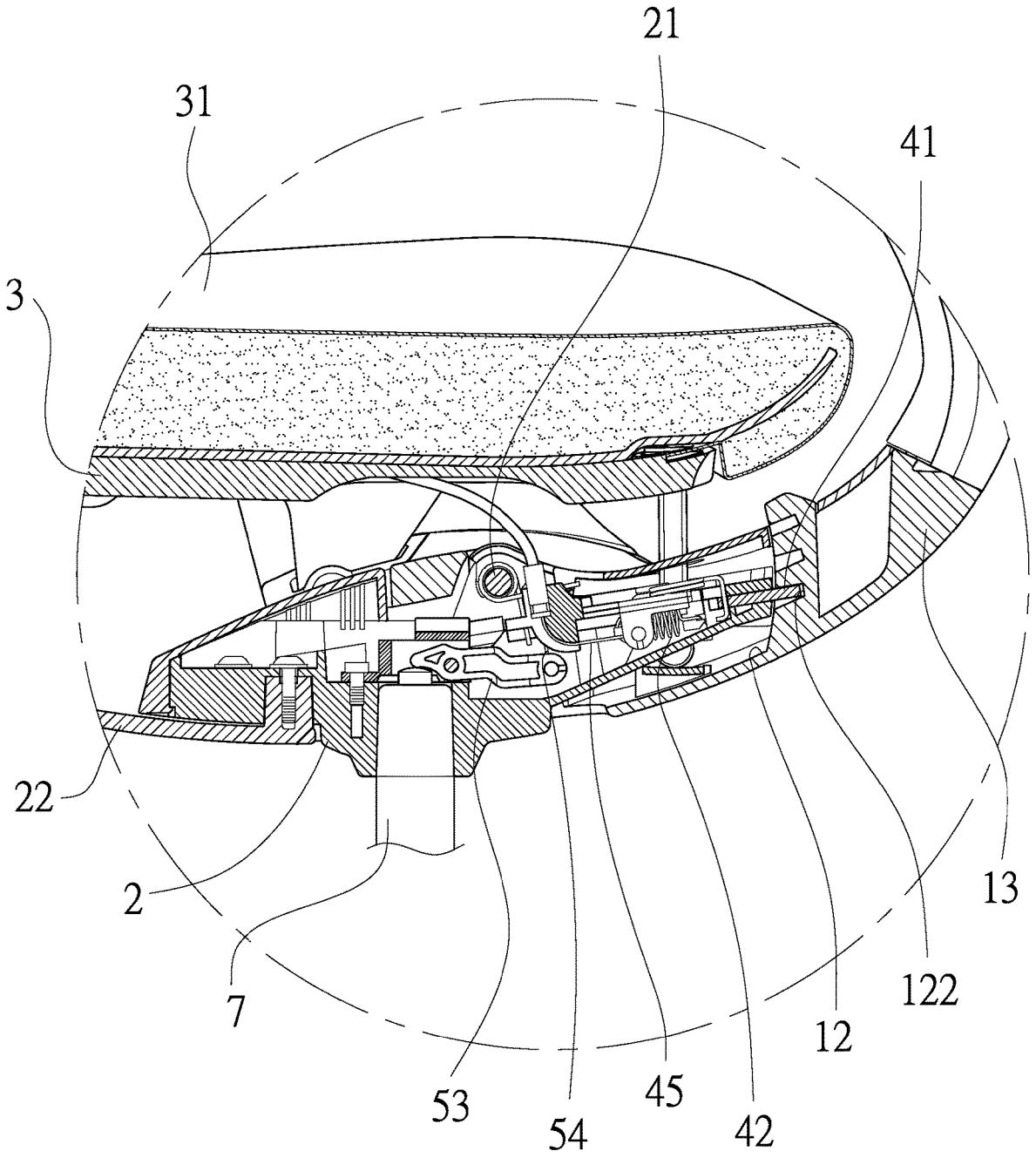
FIG. 8 is a partial enlarged sectional view showing a chair back in a locked state of an embodiment according to the present invention.

When the user is no more leaning against the chair back 6, the back spring 24 which is deformed due to the force exerted by the user against the chair back 6 returns to the original shape and drives the chair-back assembly portion 13 which is located at the rear side of the seat body 1 and connected with the chair back 6 to move back. Also refer to FIG. 8, then the user can pull the first control plate 43 of the chair-back controller 4 by his hand so that the tenon 41 connected with the first cord 45 is also driven to move through the first cord 45. Thereby the tenon 41 is locked and positioned in one of the locking grooves 122 on the rear wall of the spring assembly groove 12 of the seat body 1 for stopping the chair-back assembly portion 13 located adjacent to the rear wall of the spring assembly groove 12. Thereby the chair back 6 is fixed and released from the state interlocked with the chair seat. At the moment, the fastening member 44 disposed between the first control plate 43 and the pad plate 3 is in a locked state for fixing both the tenon 41 and the locking grooves 122. After the fastening member 44 being released from the locked state, the tenon 41 is drawn by the first elastic member 42 connected to be moved out of the locking grooves 122 and returned to the original position.

When the user is rising from the chair seat, the pad spring 23 which is deformed due to the user's sitting on the pad 31 of the pad plate 3 returns to the original shape and pulls the rod 25 connected to move downward. Thus the rear side of the pad plate 3 is also pulled by the rod 25 to move downward. By using the pivotal connection between the seat body 1 and the pad plate 3 as the pivot, the front side of the pad plate 3 is moved upward relatively to get back to a flat state.

Figure 9:
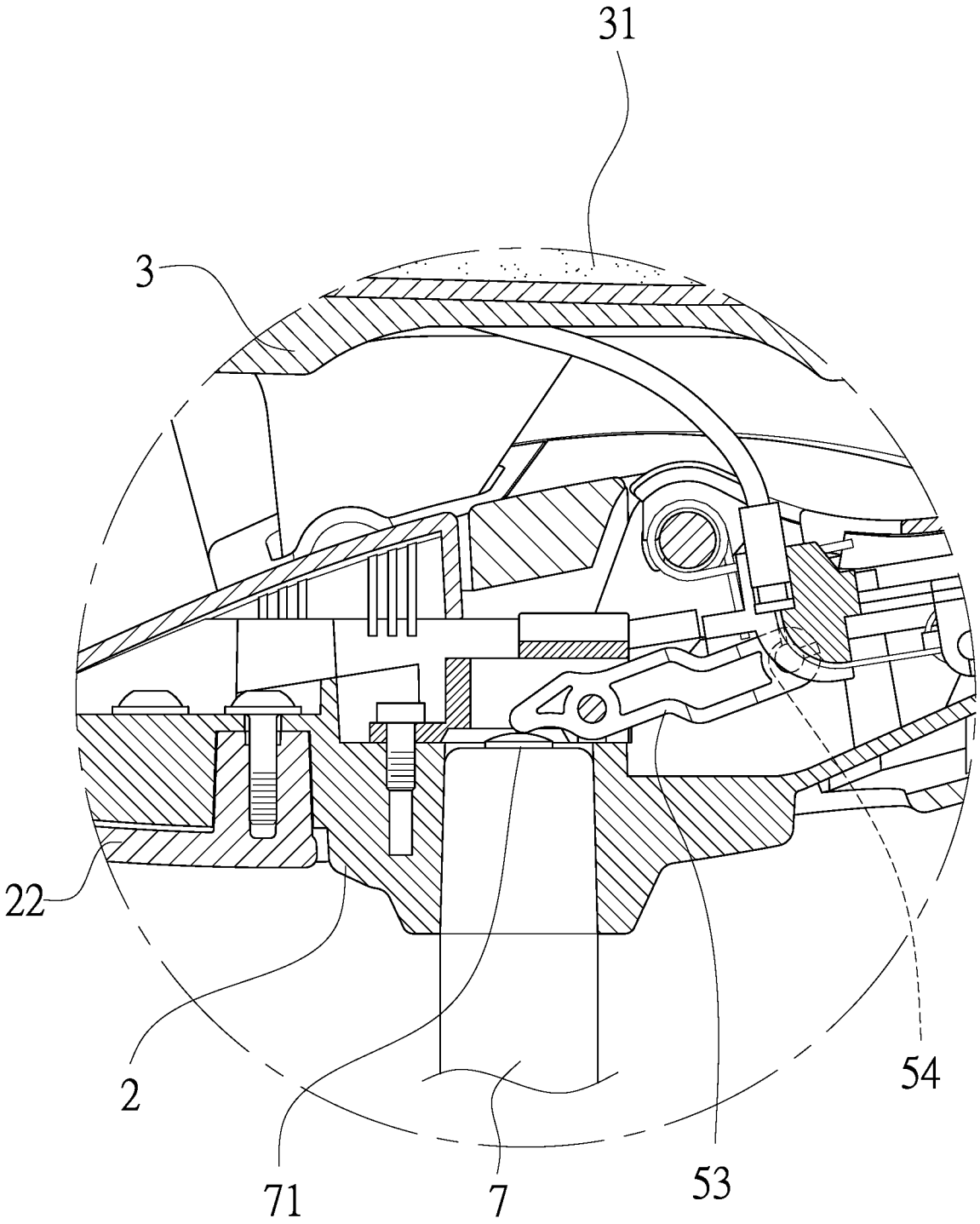
FIG. 9 is a partial enlarged sectional view showing a lifting bar in a driven state of an embodiment according to the present invention.

When the user intends to adjust the chair seat up or down, the second control plate 51 of the lifting control unit 5 is pulled so that the driving handle 53 is driven to work by the second control plate 51 through the second cord 54. Also refer to FIG. 9, the front end of the driving handle 53 presses against the button 71 of the lifting bar 7 for driving the lifting bar 7 to move the chair chassis 2 together with the chair seat parts such as the seat body 1 upward and downward. By elastic recovery of the second elastic member 52 between the second control plate 51 and the pad plate 3, the front end of the driving handle 53 is driven to be separated from the button 71 of the lifting bar 7 once the user is not pulling the second control plate 51. Thus the button 71 of the lifting bar 7 is released from the pressing and the chair seat is fixed at that height after the adjustment.

In a preferred embodiment, the connection plate 34 between the pad plate 3 and the support spring 22 of the chair chassis 2 can be omitted. The front end of the support spring 22 of the chair chassis 2 is directly abutting against and in contact with the bottom surface of the front side of the pad plate 3.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. An interlocking mechanism for a seat and a back of a chair comprising:

a seat body which includes a chassis assembly portion disposed on a front side thereof, a chair-back assembly portion arranged at a rear side thereof, and a spring assembly groove mounted between the chassis assembly portion and the chair-back assembly portion and provided with a rear wall arranged adjacent to the chair-back assembly portion;

a chair chassis arranged at the chassis assembly portion of the seat body and having at least one first pivot inserted through the chair chassis and the chassis assembly portion of the seat body for pivotal connection with the seat body, a support spring having a rear end connected with a front side of the chair chassis and extending forward from the chair chassis, at least one back spring mounted in the spring assembly groove of the seat body and having a front end connected with a rear side of the chair chassis and a rear end being locked and positioned in a locking portion disposed on the rear wall of the spring assembly groove; and a pad plate located over the seat body and the chair chassis and including at least one second pivot inserted through the pad plate and the seat body for pivotal connection with the seat body, the pivotal connection between the pad plate and the seat body is located in front of the pivotal connection between the seat body and the chair chassis; a front end of the support spring of the chair chassis abuts against a front side of the pad plate.

2. The interlocking mechanism for a seat and a back of a chair as claimed in claim 1, wherein at least one pad spring and a rod are mounted in the spring assembly groove of the seat body; a front end of the pad spring is connected with a rear side of the chair chassis, and a rear end of the pad spring is provided with a through hole for allowing the rod to insert therethrough; a stopping portion is arranged at a bottom end of the rod and abuts against a bottom surface of the pad spring, and a top end of the rod is disposed on a rear side of the pad plate; a connection plate is arranged between the front side of the pad plate and the front end of the support spring of the chair chassis, and an upper end and a lower end of the connection plate are respectively pivotally connected with the pad plate and the support spring.

3. The interlocking mechanism for a seat and a back of a chair as claimed in claim 2, wherein the connection plate is inclined downward with a positive slope and there is an angle formed between the connection plate and the pad plate.

4. The interlocking mechanism for a seat and a back of a chair as claimed in claim 3, wherein the angle formed between the connection plate and the pad plate is 6 degrees.

5. The interlocking mechanism for a seat and a back of a chair as claimed in claim 2, wherein a mounting groove is arranged at a bottom surface of the front side of the pad plate and used for mounting the connection plate therein.

6. The interlocking mechanism for a seat and a back of a chair as claimed in claim 1, wherein the support spring is curved upward from the rear end to a front end thereof.

7. The interlocking mechanism for a seat and a back of a chair as claimed in claim 1, wherein two pivot lugs are disposed on left and right sides of a bottom surface of the pad plate correspondingly; two pivot portions are arranged at left and right sides of the seat body correspondingly and located opposite to each other; the pivot portions are pivotally connected with the corresponding pivot lugs on the two sides of the pad plate by the second pivots inserted through the pivot portions and the pivot lugs.

8. The interlocking mechanism for a seat and a back of a chair as claimed in claim 1, wherein a silencer pad is arranged at a bottom of the spring assembly groove of the seat body and located under the back spring.

9. The interlocking mechanism for a seat and a back of a chair as claimed in claim 1, wherein the interlocking mechanism further includes a chair-back controller composed of a tenon mounted in the spring assembly groove of the seat body, and a first control plate arranged at one side of the pad plate and connected with the tenon; the rear wall of the spring assembly groove is provided with at least one locking groove in which the tenon is locked.

10. The interlocking mechanism for a seat and a back of a chair as claimed in claim 1, wherein the interlocking mechanism further includes a lifting control unit having a second control plate arranged at one side of the pad plate and a driving handle connected with the second control plate; wherein a hollow portion is formed in the chair chassis, and the driving handle is disposed in the hollow portion of the chair chassis and pivotally connected with the chair chassis; wherein a lifting bar is disposed at a bottom of the chair chassis and provided with a button on an upper end of the lifting bar; the upper end of the lifting bar is located in the hollow portion of the chair chassis and a front end of the driving handle is in contact with the button on the upper end of the lifting bar.

* * * * *